US008048194B2

(12) United States Patent
Rathweg

(10) Patent No.: US 8,048,194 B2
(45) Date of Patent: Nov. 1, 2011

(54) SYSTEM AND PROCESS FOR RECOVERY OF CADMIUM TELLURIDE (CDTE) FROM SYSTEM COMPONENTS USED IN THE MANUFACTURE OF PHOTOVOLTAIC (PV) MODULES

(75) Inventor: Christopher Rathweg, Louisville, CO (US)

(73) Assignee: Primestar Solar, Inc., Arvada, CO (US)

( * ) Notice: Subject to any disclaimer, the term of this patent is extended or adjusted under 35 U.S.C. 154(b) by 54 days.

(21) Appl. No.: 12/639,085

(22) Filed: Dec. 16, 2009

(65) Prior Publication Data

US 2011/0138964 A1 Jun. 16, 2011

(51) Int. Cl.
*C22B 7/00* (2006.01)

(52) U.S. Cl. ..... 75/401; 75/10.29; 423/107; 423/509; 427/248.1

(58) Field of Classification Search ..... 75/10.29, 75/401; 423/107, 509; 427/248.1
See application file for complete search history.

(56) References Cited

U.S. PATENT DOCUMENTS

| | | | | |
|---|---|---|---|---|
| 5,304,499 | A * | 4/1994 | Bonnet et al. | 438/94 |
| 5,405,588 | A | 4/1995 | Kronberg | |
| 5,437,705 | A | 8/1995 | DeLisle et al. | |
| 5,779,877 | A | 7/1998 | Drinkard, Jr. et al. | |
| 5,897,685 | A | 4/1999 | Goozner et al. | |
| 6,129,779 | A | 10/2000 | Bohland et al. | |
| 6,444,043 | B1 * | 9/2002 | Gegenwart et al. | 118/726 |
| 2009/0194165 | A1 | 8/2009 | Murphy et al. | |

* cited by examiner

*Primary Examiner* — George Wyszomierski
*Assistant Examiner* — Tima M McGuthry Banks
(74) *Attorney, Agent, or Firm* — Dority & Manning, P.A.

(57) ABSTRACT

A system and associated process are provided for recovering cadmium telluride (CdTe) that has plated onto components, such as components used in the manufacture of photovoltaic (PV) modules. The system includes a vacuum oven configured for maintaining a vacuum and being heated to a temperature effective for sublimating CdTe off of components placed within the oven. A collection member is disposed so that sublimated CdTe generated in the oven diffuses to the collection member. The collection member is maintained at a temperature effective for causing the sublimated CdTe to plate thereon. The collection member is subsequently processed to collect the plated CdTe.

11 Claims, 4 Drawing Sheets

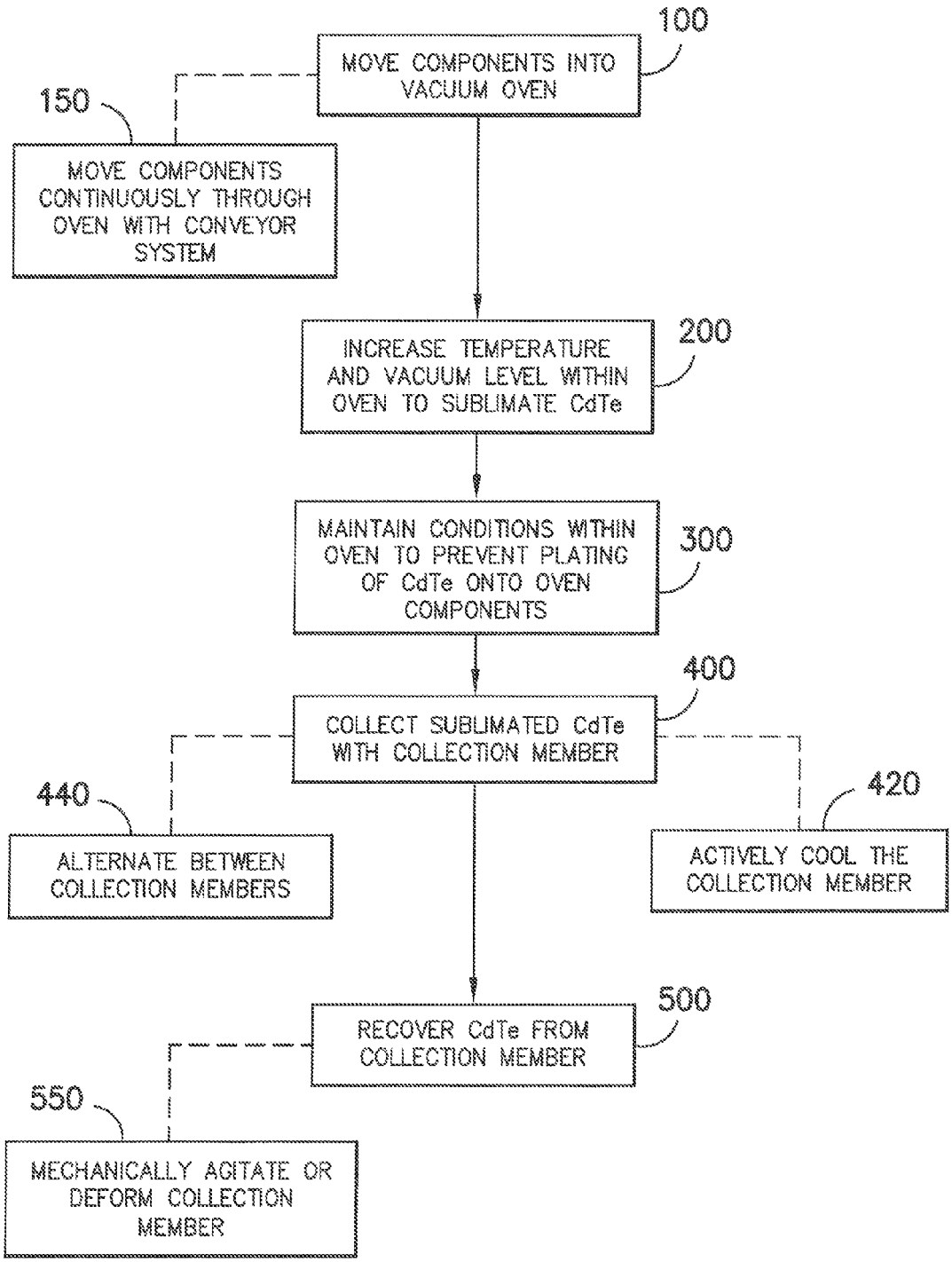
FIG. —4—

SYSTEM AND PROCESS FOR RECOVERY OF CADMIUM TELLURIDE (CDTE) FROM SYSTEM COMPONENTS USED IN THE MANUFACTURE OF PHOTOVOLTAIC (PV) MODULES

FIELD OF THE INVENTION

The subject matter disclosed herein relates generally to the field of reclamation systems and processes used to recover metallic semiconductor materials from components. More particularly, the invention is related to a system and process for recovering cadmium telluride (CdTe) from system components used in the manufacture of photovoltaic (PV) modules.

BACKGROUND OF THE INVENTION

Thin film photovoltaic (PV) modules (also referred to as "solar panels") based on cadmium telluride (CdTe) paired with cadmium sulfide (CdS) as the photo-reactive components are gaining wide acceptance and interest in the industry. CdTe is a semiconductor material having characteristics particularly suited for conversion of solar energy (sunlight) to electricity. For example, CdTe has an energy bandgap of 1.45 eV, which enables it to convert more energy from the solar spectrum as compared to lower bandgap (1.1 eV) semiconductor materials historically used in solar cell applications. Also, CdTe converts energy more efficiently in lower or diffuse light conditions as compared to the lower bandgap materials and, thus, has a longer effective conversion time over the course of a day or in low-light (e.g., cloudy) conditions as compared to other conventional materials. Solar energy systems using CdTe PV modules are generally recognized as the most cost efficient of the commercially available systems in terms of cost per watt of power generated. However, the advantages of CdTe not withstanding, sustainable commercial exploitation and acceptance of solar power as a supplemental or primary source of industrial or residential power depends on the ability to produce efficient PV modules on a large scale and in a cost effective manner.

CdTe is a relatively expensive material, and efficient utilization of this material is a primary cost factor in the production of the PV modules. Regardless of the type of deposition system or process, some degree of the CdTe material will inevitably be "wasted" in that it is not deposited onto the PV module. For example, the material may plate out (i.e., condense) on the processing equipment, including shields, conveyor components, vessels, and the like. Recovery and recycling of this material is a key consideration in the industry. In addition, CdTe (and Cd in general) is considered a hazardous material, and the disposal requirements for components that contain CdTe are quite strict and add significantly to the overall cost of the PV module production. Reduction of the volume of these hazardous material components is another primary consideration.

Various references discuss systems and techniques for removal of Cd from scrap metal in general, and PV modules in particular. For example, U.S. Pat. No. 5,405,588 describes a chemical process for recovery of Cd wherein scrap materials containing the Cd are mixed with an ammonium carbonate solution to form a water-soluble ammine complex, which is then evaporated to form a second mixture of cadmium carbonate. The second mixture is further processed to recover the cadmium in the form of cadmium sulfide. U.S. Pat. Nos. 5,897,685, 5,779,877 and 6,129,779 all relate to chemical methods for recovering metals, such as CdTe, from scrap PV modules. Although these processes may have utility, they involve relatively complicated chemical processes requiring acids and other fluids that are expensive, difficult to work with, and pose their own environmental hazards and disposal issues.

U.S. Pat. No. 5,437,705 describes a process and system for recovering cadmium and nickel from Ni—Cd batteries, wherein the scrap batteries and battery components are heated in a retort oven at an effective temperature and time to vaporize the cadmium. The vaporized cadmium is directed into a condensing chamber, wherein the cadmium is condensed to liquid form and directed into molds. This chamber is an elongated tubular component wherein the temperature is maintained at decreasing levels along the length of the chamber, with the lowest temperature being at the outlet of the chamber. Temperature at the molds is maintained high enough to ensure that the cadmium is stored in the molds in liquid form for a time sufficient to allow ash contaminates to rise to the top of the liquid. This condensation system and process is not suited for CdTe recovery in that the unique characteristics of CdTe do not allow for processing of a liquid condensate.

Accordingly, there exists a need for an improved process and system that are uniquely suited for efficient and clean recovery of CdTe from PV modules or components used in the production of PV modules. The present invention relates to a recovery system and process that serve this purpose.

BRIEF DESCRIPTION OF THE INVENTION

Aspects and advantages of the invention will be set forth in part in the following description, or may be obvious from the description, or may be learned through practice of the invention.

In accordance with an embodiment of the invention, a process is provided for recovering cadmium telluride (CdTe) that has plated onto components used in the manufacture of photovoltaic (PV) modules. The process includes locating the components in a vacuum oven and then drawing a vacuum and raising the temperature in the oven to a level effective for sublimating the CdTe off of the components. The temperature and vacuum conditions are maintained within the oven at levels effective for preventing the sublimated CdTe from plating onto internal components of the oven. The sublimated CdTe generated in the oven diffuses to a collection member that is maintained at a temperature effective for causing the sublimated CdTe to plate thereon. This collection member may be within the oven or remote from the oven. The plated CdTe is eventually recovered from the collection member by, for example, mechanically agitating or deforming the collection member to cause the plated CdTe to flake off of the collection member. This recovery step may take place within the oven or remote from the oven.

Variations and modifications to the embodiment of the recovery process discussed above are within the scope and spirit of the invention and may be further described herein.

The present invention also encompasses system embodiments for recovering cadmium telluride (CdTe) that has plated onto components used in the manufacture of photovoltaic (PV) modules. In a particular embodiment, the system includes a vacuum oven configured for maintaining a vacuum and being heated to a temperature effective for sublimating CdTe off of components placed within the oven. A collection member is disposed so that the sublimated CdTe generated in the oven diffuses to the collection member, which is maintained at a temperature effective for causing the sublimated CdTe to plate thereon. The collection member may be disposed within the oven or remote from the oven, and may be cooled to enhance the plating process. The collection member is further configured for subsequent processing to remove and collect the CdTe by, for example, being mechanically agitated or deformed to cause the plated CdTe to flake or disengage therefrom. The collection member may be removable from the oven (or remote location) for this collection process.

Variations and modifications to the embodiment of the system discussed above are within the scope and spirit of the invention and may be further described herein.

These and other features, aspects and advantages of the present invention will become better understood with reference to the following description and appended claims.

BRIEF DESCRIPTION OF THE DRAWING

A full and enabling disclosure of the present invention, including the best mode thereof, is set forth in the specification, which makes reference to the appended drawings, in which.

DETAILED DESCRIPTION OF THE INVENTION

Figure 1:
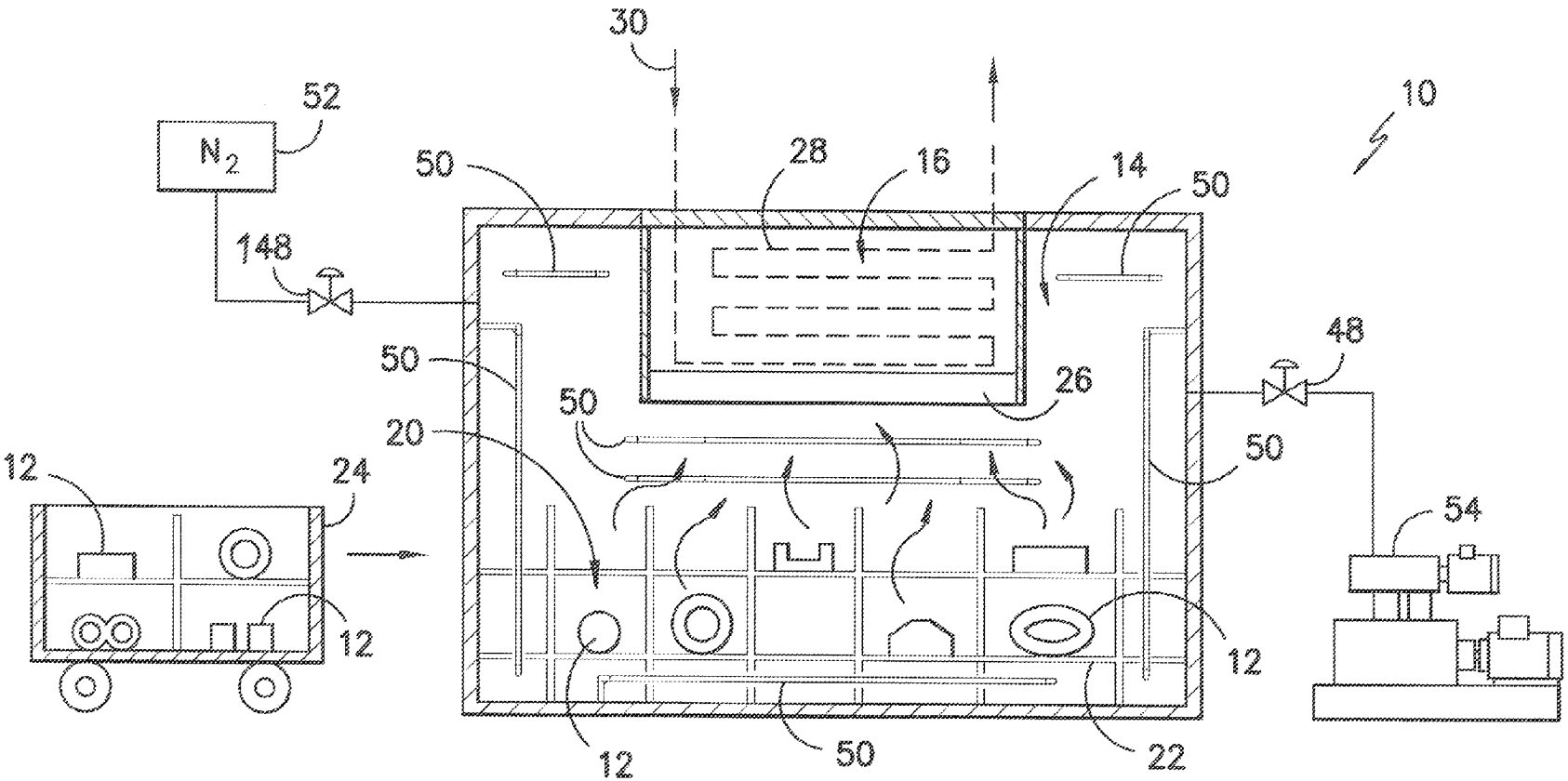
FIG. 1 is a diagrammatic view of an embodiment of a system in accordance with aspects of the invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used with another embodiment to yield a still further embodiment. Thus, it is intended that the present invention encompass such modifications and variations as come within the scope of the appended claims and their equivalents.

FIG. 1 illustrates a system 10 in accordance with certain aspects of an embodiment of the invention. The system 10 includes a vacuum oven 14 of any conventional design. The vacuum oven 14 is configured for maintaining a vacuum and being heated to a temperature that are effective for sublimating CdTe off of various types of components 12 that are placed within the oven. Any array or configuration of heating elements 50 may be disposed within the oven 14, for example on the chamber walls of the oven 14, to achieve and maintain the desired temperature. Likewise, any manner or configuration of vacuum pump 54 (or combination of pumps) may be in communication with the oven 14 via a suitable isolation valve 48 for purposes of drawing and maintaining the desired vacuum within the oven 14.

Although the invention is not limited to use with any particular types of components, the components 12 placed within the oven 14 may be components used in a manufacturing or processing line that makes photovoltaic (PV) modules. For example, the components 12 may be shields, heating elements, conveyor components, and so forth, used in a PV module production process. The components 12 are placed in any suitable receptacle, rack, or other configuration 20 within the oven 14. For example, any configuration of a rack or similar device 22 may be configured within the oven 14 for holding components 12 of various shapes, and sizes. The components 12 may be moved into and out of the oven 14 by, for example, a cart 24 or other suitable transport mechanism. The cart 24 may also be left in the oven 14 and serve as the receptacle 20.

In the particular embodiment of FIG. 1, a collection member 16 is disposed within the oven 14. For example, the collection member 16 may be disposed on a top wall or surface of the oven 14, on a side wall, or supported on the base or floor of the oven 14. Desirably, the collection member 16 is maintained as the coolest component within the oven 14. The collection member 16 presents an exposed surface to the interior volume of the oven 14 that is maintained at a temperature to ensure that the sublimated CdTe generated in the oven 14 that diffuses to and contacts the surface, will plate onto the surface. The other components within the oven 14 are maintained at a temperature that prevents the sublimated CdTe from plating thereon.

As mentioned, the temperature and vacuum within the oven 14 are maintained at levels effective for sublimating CdTe from the components 12 placed within the oven. Suitable temperatures may be in the range of, for example, about 650 degrees to about 850 degrees Celsius. Vacuum may be in the range of, for example, about $10^{-5}$ to about $10^{-3}$ Torr. A fine (high) vacuum pump may be necessary to obtain these vacuum values. It may be that a vacuum of about $10^{-2}$ Torr also suffices, for which a rough vacuum pump alone may be suitable.

The collection member 16 may take on various configurations. In the illustrated embodiment, the collection member 16 includes a base 28, and a tray 26 that is removably configured on the base 28. The tray 26 defines the surface discussed above that is presented to the interior volume of the oven 14. In order to maintain the tray 26 at the desired temperature, the base 28 may be internally cooled by a cooling medium 30 that is cycled through tubes or other heat exchange members configured in the base 28. The external cooling medium 30 may be, for example, a gas, chill water, refrigerant, or any other suitable heat exchange medium.

Desirably, the tray 26 is removable from the base 28 so that the tray 26 can be removed from the oven 14 for subsequent processing and removal of the CdTe material that has plated onto the surface of the tray 26.

The invention is not limited by the processing step by which the CdTe is removed from the collection member. In a particular embodiment, it may be that the tray 26 (or other surface on which the CdTe has plated) can be mechanically agitated or deformed, for example by shaking, banging, or bending the tray. This deformation or mechanical agitation may be sufficient to cause the CdTe plated on the member to flake off or otherwise disengage from the surface of the tray 26. This process would desirably take place in a controlled environment to ensure that any CdTe dust is ventilated and filtered in accordance with applicable health standards and requirements.

Still referring to FIG. 1, an inert gas supply 52 is depicted in communication with the oven 14 through an isolation valve 148. Supply of an inert gas, such as nitrogen, may be desired for any number of reasons. For example, the inert gas may be introduced into the oven 14 during a cool-down phase wherein temperature within the oven is reduced for introduction or removal of the components 12 therefrom.

Figure 2:
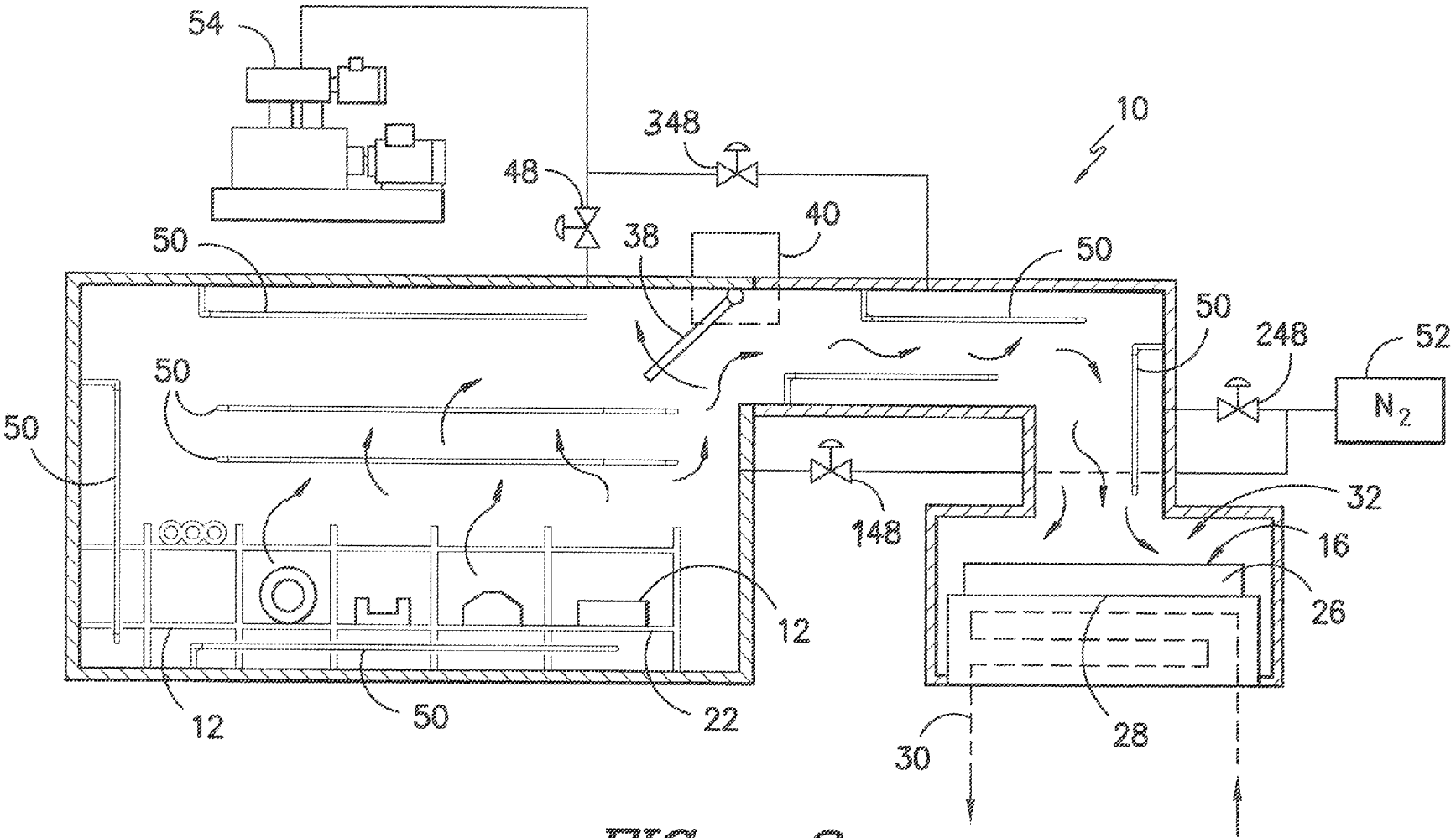
FIG. 2 is a diagrammatic view of an alternate embodiment of a system in accordance with aspects of the invention.

FIG. 2 illustrates an alternate embodiment of a system 10 wherein the collection member 16 is located remote from the oven 14. In this embodiment, the collection member 16 is located within a remote chamber 32 that is in communication with the oven 14 through any manner of ducting or other type of structure. An isolation mechanism 38, such as a valve or gate, may be operationally configured between the oven 14 and the remote chamber 32. This mechanism may be controlled by an actuator or other control mechanism 40 to isolate the chamber 32 from the oven 14 for any purpose. For example, it may be desired to cool the chamber 32 in order to remove the tray 26 without necessarily interrupting the sublimation process ongoing within the oven 14. The inert gas supply 52 may, therefore, also be in communication with the chamber 32 through an isolation valve 248, as well as in communication with the oven 14 through an isolation valve 148, as depicted in FIG. 2.

Still referring to FIG. 2, in order to independently control the processes within the oven 14 and the chamber 32, the vacuum pump or pumps 54 are also configured to alternately draw and maintain a vacuum in the oven 14 and chamber 32 through separate lines that communicate with the respective spaces through appropriate isolation valves 48. In this manner, the same pump or pump configuration may be used to separately and independently draw vacuums within the oven 14 and the chamber 32. In an alternate configuration, it should be appreciated that separate vacuum pumps may be provided for each of the respective spaces.

In order to ensure that the sublimated CdTe does not plate out on the ducting or other structure that connects the chamber 32 to the oven 14, it may be desired to configure heating elements 50 within the duct work, as depicted in FIG. 2. As mentioned above, it is the intent to prevent the sublimated CdTe from plating onto the oven or chamber components and to cause the CdTe to diffuse to the cooled surface of the tray 26 configured with the collection member 16.

Figure 3:
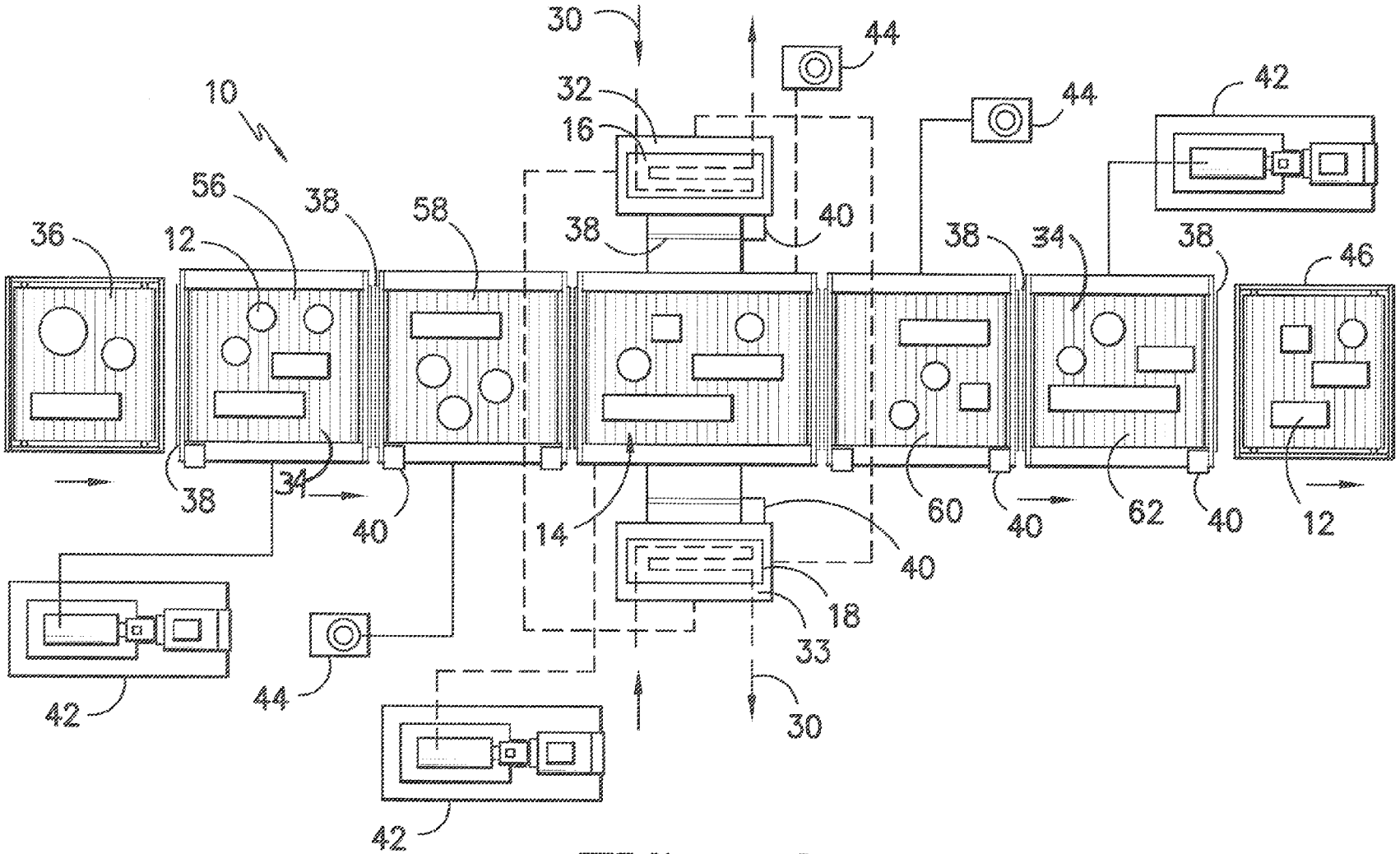
FIG. 3 is a top plan view of still another embodiment of a system in accordance with the invention; and, FIG. 4 is a block diagram of an embodiment of a process in accordance with the invention.

FIG. 3 illustrates yet another embodiment 10 of a system in accordance with aspects of the invention. In this embodiment, the system 10 includes a first collection member 16 operationally configured within a first remote chamber 32 that is in communication with the oven 14, and a second collection member 18 that is operationally configured within a second remote chamber 33 that is also in communication with the oven 14. Each of the chambers 32, 33 may be independently isolated from the oven 14 by way of a mechanism 38 and respective actuator 40. With this unique configuration, one of the collection members 16, 18 may be placed in service while the other collection member 18, 16 is isolated from the oven 14 for any reason, such as removal of the tray component for subsequent collection of the CdTe. The isolated chamber 32, 33 may also be serviced at this time and prepared for being placed back into service. In this manner, the process can alternate between the collection members 16, 18 (and respective chambers 32, 33) so as not to interrupt the ongoing sublimation process within the oven 14.

FIG. 3 also illustrates use of a "rough" (initial) vacuum pump 42 and a "fine" (high) vacuum pump 44 that function with the oven 14 and each of the chambers 32, 33. For example, the rough vacuum pump 42 may be used to draw the initial vacuum within the oven 14 and either or both of the chambers 32, 33 that are placed in service. Likewise, the fine vacuum pump 44 may also be used to draw the final vacuum within the oven 14 and either of the chambers 32, 33 that are placed in service at the time. The respective vacuum pumps 42, 44 are also in independent communication (e.g., isolated from the oven 14) with the respective chambers 32, 33, as indicated by the dashed lines in FIG. 3, for evacuating the chambers or drawing a vacuum in the chambers as necessary. It should also be appreciated that any manner of multiple vacuum pumps may be provided, with dedicated pumps being configured with the oven 14, and respective chambers 32, 33.

The embodiment of FIG. 3 also provides a conveyor 34 that is configured to move the components 12 into and out of the oven 14 through a combination of vacuum locks. In this manner, a continuous supply of components can be introduced into the oven 14 and removed from the oven 14 without interrupting the heating and sublimation process. Collection of the sublimated CdTe can alternate between the first collection member 16, and the second collection member 18 to support the ongoing and continuous process.

Referring to FIG. 3, the components 12 may be initially placed on a load table 36. A load module 56 and a buffer module 58 are operationally configured upstream of the oven 14 in the conveyance direction of the conveyor 34. Respective isolation devices ("gates") 38 and associated controllers 40 are disposed between the load table 36 and the load module 56, between the load module 56 and buffer module 58, and between the buffer module 58 and the oven 14. The oven 14 may be isolated from the load and buffer modules 56, 58 by way of the gate 38 between the buffer module 58 and oven 14. The module 56 may then be evacuated and vented, with the gate 38 between module 56 and 58 closed. The gate 38 between the load table 36 and load module 56 is opened and the components 12 are loaded onto the conveyor 34. The initial gate 38 is closed and the rough vacuum pump 42 is used to draw an initial vacuum within the load module 56. In the mean time, the fine vacuum pump draws an increased vacuum in module 58. At a certain vacuum pressure, the gate 38 between the module 58 and 58 is opened and the components 12 are conveyed into the buffer module 58, and the gate 38 between the load module 56 and 58 is closed. The fine vacuum pump 44 is used to draw a final vacuum in the buffer module 58. Once the pressures between the buffer module 58 and oven 14 are essentially equalized, the gate 38 between the buffer module 58 and oven 14 is opened and the components 12 are conveyed into the oven 14.

A buffer module 60 and exit module 62 are operationally configured downstream of the oven 14 in the conveyance direction of the conveyor 34 for subsequent removal of the components 12 after they have been processed within the oven 14. Gates 38 are operationally configured between the oven 14 and buffer module 60, between the buffer module 60 and exit module 62, and between the exit module 62 and an exit table 46. The vacuum lock process for removal of the components via the buffer module 60 and exit module 62 is essentially the reverse of the process discussed above for the entry vacuum lock process.

It should be appreciated that the unique embodiment 10 of FIG. 3 offers various advantages. For example, a continuous stream or supply of components 12 may be moved through the oven 14 without having to cool down and subsequently heat up the oven for introduction and removal of the components. The through-put of the system may be significantly increased in this regard. In addition, the use of alternate collection members 16, 18 supports the continuous process in that the process need not be interrupted for removal or substitution of the collection members 16, 18.

The present invention also encompasses various process embodiments for recovering CdTe that has plated onto components, such as components used in the processing or manufacture of PV modules. Exemplary process steps are depicted in the flow chart of FIG. 4. It should be appreciated that the process embodiments may be carried out by any suitable configuration of equipment, and are not limited to the system or apparatus embodiments discussed above.

Referring to FIG. 4, at step 100, any manner of components are moved into a vacuum oven. These components may be moved in batches, for example on a cart or other transport mechanism, or moved continuously through the oven with a conveyor system, as depicted at step 150.

At step 200, temperature and vacuum level within the oven are increased and maintained at levels effective for sublimating CdTe material from the components located within the oven. At step 300, the conditions within the oven are maintained to prevent the sublimated CdTe from plating onto the oven components.

At step 400, the sublimated CdTe is collected with a collection member. In this step, the sublimated CdTe diffuses to a collection member that is maintained at a temperature effective for causing any of the CdTe that contacts a surface of the collection member to plate onto the member. The collection member may be actively cooled at step 420 by, for example, an external cooling medium such as a gas, chill water, refrigerant, or the like.

At step 440, the process of collecting the sublimated CdTe with a collection member may alternate between different collection members so as to sustain a continuous sublimation process within the oven, as discussed above in the example of FIG. 3.

At step 500, the CdTe is recovered from the collection member. This process step may be carried out in various ways. For example, at step 550, the collection member may be mechanically agitated or deformed in a controlled environment to cause the plated CdTe to flake off of the collection member for subsequent collection. In an alternative embodiment, it may be desired to chemically treat the collection members to remove the CdTe therefrom.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A process for recovering cadmium telluride (CdTe) that has plated onto components, the process comprising:

locating the components in a vacuum oven;

drawing a vacuum and heating the oven to raise the temperature in the oven to levels effective for sublimating the CdTe off of the components;

maintaining temperature and vacuum conditions within the oven at levels effective for preventing the sublimated CdTe from plating onto internal components of the oven;

allowing the sublimated CdTe generated in the oven diffusing to a collection member that is maintained at a temperature effective for causing the sublimated CdTe to plate thereon; and, removing the plated CdTe from the collection member.

2. The process as in claim 1, wherein the components are components used in the manufacture of photo voltaic (PV) modules.

3. The process as in claim 1, wherein the collection member is disposed within the oven and maintained as the coolest component within the oven.

4. The process as in claim 3, wherein an additional collection member is configured remote from the oven, the process further comprising alternating between the collection members such that one of the collection members is used to collect the CdTe being sublimated in the oven while the other collection member is processed for removing CdTe plated thereon.

5. The process as in claim 1, wherein the collection member is disposed remote from the oven and the sublimated CdTe diffuses out of the oven to the collection member.

6. The process as in claim 1, further comprising supplying an inert gas to the heated oven.

7. The process as in claim 1, wherein the components are moved into and out of the oven without interrupting the heating and vacuum process within the oven.

8. The process as in claim 7, wherein the components are moved on a conveyor through vacuum locks into and out of the oven.

9. The process as in claim 8, wherein an additional collection member is configured remote from the oven, the process further comprising alternating between the collection members such that one of the collection members is used to plate out and collect the CdTe being sublimated in the oven while the other collection member is processed for removing CdTe plated thereon.

10. A process for recovering cadmium telluride (CdTe) that has plated onto components, the process comprising:

locating the components in a vacuum oven;

drawing a vacuum and heating the oven to raise the temperature in the oven to levels effective for sublimating the CdTe off of the components;

maintaining temperature and vacuum conditions within the oven at levels effective for preventing the sublimated CdTe from plating onto internal components of the oven;

allowing the sublimated CdTe generated in the oven diffusing to a collection member that is maintained at a temperature effective for causing the sublimated CdTe to plate thereon;

removing the plated CdTe from the collection member; and further comprising actively cooling the collection member with a recirculating cooling medium.

11. A process for recovering cadmium telluride (CdTe) that has plated onto components, the process comprising:

locating the components in a vacuum oven;

drawing a vacuum and heating the oven to raise the temperature in the oven to levels effective for sublimating the CdTe off of the components;

maintaining temperature and vacuum conditions within the oven at levels effective for preventing the sublimated CdTe from plating onto internal components of the oven;

allowing the sublimated CdTe generated in the oven diffusing to a collection member that is maintained at a temperature effective for causing the sublimated CdTe to plate thereon;

removing the plated CdTe from the collection member; and further comprising mechanically agitating or deforming the collection member to cause the plated CdTe to flake off of the collection member.

* * * * *